US008360265B1

(12) United States Patent
Andrews

(10) Patent No.: US 8,360,265 B1
(45) Date of Patent: Jan. 29, 2013

(54) CONTAINER AND LID FOR SAWHORSE APPLICATION

(76) Inventor: Jeffrey Andrews, Wallingford, CT (US)

( * ) Notice: Subject to any disclaimer, the term of this patent is extended or adjusted under 35 U.S.C. 154(b) by 1258 days.

(21) Appl. No.: 11/771,237

(22) Filed: Jun. 29, 2007

(51) Int. Cl.
*B65D 1/44* (2006.01)

(52) U.S. Cl. ..... 220/659; 220/675

(58) Field of Classification Search ..... 220/675, 220/908, 4.21, 23.86, 695, 729, 735, 694, 220/659, 657, 656; 174/53, 58; 182/224, 182/225, 181.1
See application file for complete search history.

(56) References Cited

U.S. PATENT DOCUMENTS 1,101,610 A 6/1914 Allard
2,624,907 A * 1/1953 Graham ..... 220/840
3,349,869 A * 10/1967 Evans ..... 182/226
4,391,369 A * 7/1983 Stahl et al. ..... 206/506
4,494,627 A 1/1985 Arent
4,875,878 A * 10/1989 Meyer ..... 439/501
4,976,366 A * 12/1990 Russell ..... 220/4.21
5,350,065 A 9/1994 Darrey
5,351,730 A 10/1994 Lewellen et al.
6,485,691 B1 11/2002 Jones
7,017,773 B2 * 3/2006 Gruber et al. ..... 220/675
D521,203 S * 5/2006 Sofy et al. ..... D34/1

OTHER PUBLICATIONS

Wikipedia web page, Lumber, Aug. 28, 2010.*

* cited by examiner

*Primary Examiner* — Stephen Castellano
(74) *Attorney, Agent, or Firm* — Robert Curcio; DeLio & Peterson, LLC

(57) ABSTRACT

A container having a dual use as a receptacle for debris that can accommodate a sawhorse application. Square or U-shaped recesses are located in the rim of the container for securing a sawhorse support, such as a board. Sawhorse supports are friction fit, or securely mounted to the container by pin, screw, nail, or bolt attachment. A lid having a slotted structure for receiving a sawhorse support may be used to transform a common household container into a sawhorse.

14 Claims, 12 Drawing Sheets

CONTAINER AND LID FOR SAWHORSE APPLICATION

BACKGROUND OF THE INVENTION

1. Field of the Invention

The present invention relates to a container having a dual use as a receptacle for debris that can be converted into a sawhorse. Additionally, the present invention teaches a lid for transforming a common household container into a sawhorse. Specifically, the invention relates to a container, or a lid for a container, having a modified rim on a top surface, or a modified bottom surface, with recesses or protrusions for holding a board in a tight, friction-fit insertion in a position that allows the user to set up the container and use it as a sawhorse.

2. Description of Related Art

Carpenters and other types of construction workers often use work platforms which are commonly referred to as sawhorses. Sawhorses are typically rigidly constructed from wood and present a wooden work platform upon which boards and the like are placed for cutting and/or fabrication. Often sawhorses are constructed on the job site because of their awkward shape and the attendant difficulty with which they are transported. Although the original use for a sawhorse was to provide a rack to support something being sawed, today's professional construction workers, farmers, and home hobbyists use sawhorse type devices to create a work surface, a raised storage surface, a barricade, scaffolding, and other similar support structures as well as to support items to be sawed.

Generally, a sawhorse is a beam with four legs. FIG. 1 depicts the typical sawhorse 10 of the prior art. Four separate, splayed legs 12 extend from beam 14, and are strengthened by support brackets 16. Sawhorses are generally used to support a board or plank for sawing. A pair of sawhorses is typically useful to support a plank or a door, or for forming a scaffold. A sawhorse with a wide top is particularly useful to support a board for sawing or for use as a field workbench. It is desirable to have a sawhorse that can accommodate a wide work surface as a field workbench or a narrow work surface for supporting heavier weights, depending upon the specific use.

The capability of handling heavy loads is important with sawhorses, especially in commercial construction. Stability and durability are features of a commercial sawhorse as well. The sawhorse needs to be designed such that it disperses the stress forces and the weight of its load across as broad an area as possible, to provide maximum support with minimum stress, or have reinforced support structures at the weight-bearing points that can withstand the weight. One such example of this in the prior art is the fitting of the wooden legs flush against an attachment bracket to spread the load stress points over an extended area.

In many instances, sawhorses are fabricated at the worksite from extra, or unused material, usually woodcuttings. It is not uncommon for home hobbyists to use makeshift materials as footings for a board or plank in the fabrication of a homemade sawhorse. These designs generally do not have the structural or mechanical integrity of prefabricated, braced sawhorses. They are generally heavy, cumbersome, and unstable. It is desirable to have a sawhorse that is constructed of a strong, resilient, yet light material that sufficiently provides the necessary structural integrity usually expected for the construction jobs requiring sawhorses.

Additionally, during the workday, as the sawhorse is used in its common fashion, the area surrounding the sawhorse eventually becomes littered with discarded material, such as end-pieces of unused wood, and other worksite debris. It is desirable to have a sawhorse a worker can use that facilitates a cleaner work environment during usage.

Home use is always a challenge for work tools. Most people do not have all the equipment, space, or resources available when they undertake a home project. With this in mind, it is extremely desirable to have a sawhorse that can provide for more than one function for the home site, thus minimizing the amount of space required for storing, while allowing the home hobbyist to get more than one type of use from the same apparatus.

It is not uncommon for home hobbyists to situate a board or plank between garbage cans to make a sawhorse. This is structurally unstable, and in many respects, unsafe. Yet, garbage containers are ubiquitous in almost every home. It is desirable to give home hobbyists the opportunity to safely convert a container, such as a garbage can, into a sawhorse when the need arises.

Everyone is interested in low cost; and, therefore, it is also desirable to make the sawhorse of inexpensive material that is strong, light, and easy to manufacture, such as extruded or molded plastic, formed metal alloy, and the like. Construction sights are not known for gentleness and any tool or device that is intended for use on-site must be able to withstand rough treatment.

Designs in the prior art lack a dual use structure or container that can perform its container function as well as having the capability to be used as a structurally sound sawhorse. In U.S. Pat. No. 1,101,610 issued to H. W. Allard on Jun. 30, 1914, entitled "RAILING SUPPORT," a support for planks and the like is taught. A lantern-receiving support is disclosed with stirrups at the upper ends of a collapsible frame. Each support frame comprises a pair of similar frame members, pivoted together at their upper ends. The frame is formed by suitably bending a single piece of metal. The upper portion of the frame is bent to configure the stirrup. Two frame members are adapted to be swung apart and locked in an open position by hook members hinged to one of the frame members. When the frame members are separated, the lower ends of the stirrups are separated as well, so that the stirrups can engage the abutting ends of a pair of boards. This prior art does not teach or disclose a dual use sawhorse/container design.

Containers are used in the prior art for holding various tools, but none are constructed for use as a dual-purpose sawhorse. In U.S. Pat. No. 5,350,065 issued to Darrey on Sep. 27, 1994, entitled "TOOL AND HARDWARE CARRIER FOR BUCKET," a bucket for carrying hand tools is disclosed, including a bucket with a planar, circular top, and a cylindrical cavity located at the axial center of the bucket. The top has holes and slots to receive tools. The top also includes two swivel-locking devices opposite one another. The inner cylindrical space may be used to put loose articles in such as nuts, bolts, screws, nails, or other small irregularly shaped objects. This design teaches a container for holding small tools, but does not teach or suggest use as a sawhorse.

In U.S. Pat. No. 5,351,730 issued to Lewellen, et al., on Oct. 4, 1994, entitled "MULTIPURPOSE PORTABLE WORKBENCH," a carpenter's workbench is disclosed. The workbench has a T-shaped profile and a V-shaped groove at its top surface. The workbench has a generally rectangular body with four legs, uniformly formed of plastic material. The T-shaped channel is open ended and intended for use in receiving a length of lumber so that ends thereof, which overhang the workbench body may be cut. Similarly, the V-groove is designed to hold a pipe for cutting. The Lewellen design does not provide a dual-purpose, container-type base structure or lid for converting a container into a board-holding sawhorse.

SUMMARY OF THE INVENTION

Bearing in mind the problems and deficiencies of the prior art, it is therefore an object of the present invention to provide an apparatus that can perform a dual function as a container and a sawhorse for home and commercial use.

It is another object of the present invention to provide a lid to convert a container into a sawhorse.

Still other objects and advantages of the present invention will in part be obvious and will in part be apparent from the specification.

The above and other objects, which will be apparent to those skilled in the art, are achieved in the present invention which is directed to a container having a top surface rim and an open interior portion, comprising at least one recess in the rim for receiving a sawhorse support, such that the open interior portion is accessible during sawhorse applications when the sawhorse support is placed in the at least one recess.

In a second aspect the present invention is directed to a container having a bottom surface and an open top interior portion, comprising: at least one slotted structure in or on said bottom surface for receiving a sawhorse support; at least one strengthening rib or side wall support structure at a location near or adjacent to the at least one slotted structure; the at least one slotted structure and the at least one strengthening rib or sidewall support structure integrally formed with the container.

In a third aspect, the present invention is directed to a container lid for a sawhorse support having a top surface and a bottom surface, the lid comprising at least one slotted structure on the top surface for receiving a sawhorse support.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-8 of the drawings in which like numerals refer to like features of the invention.

Figure 1:
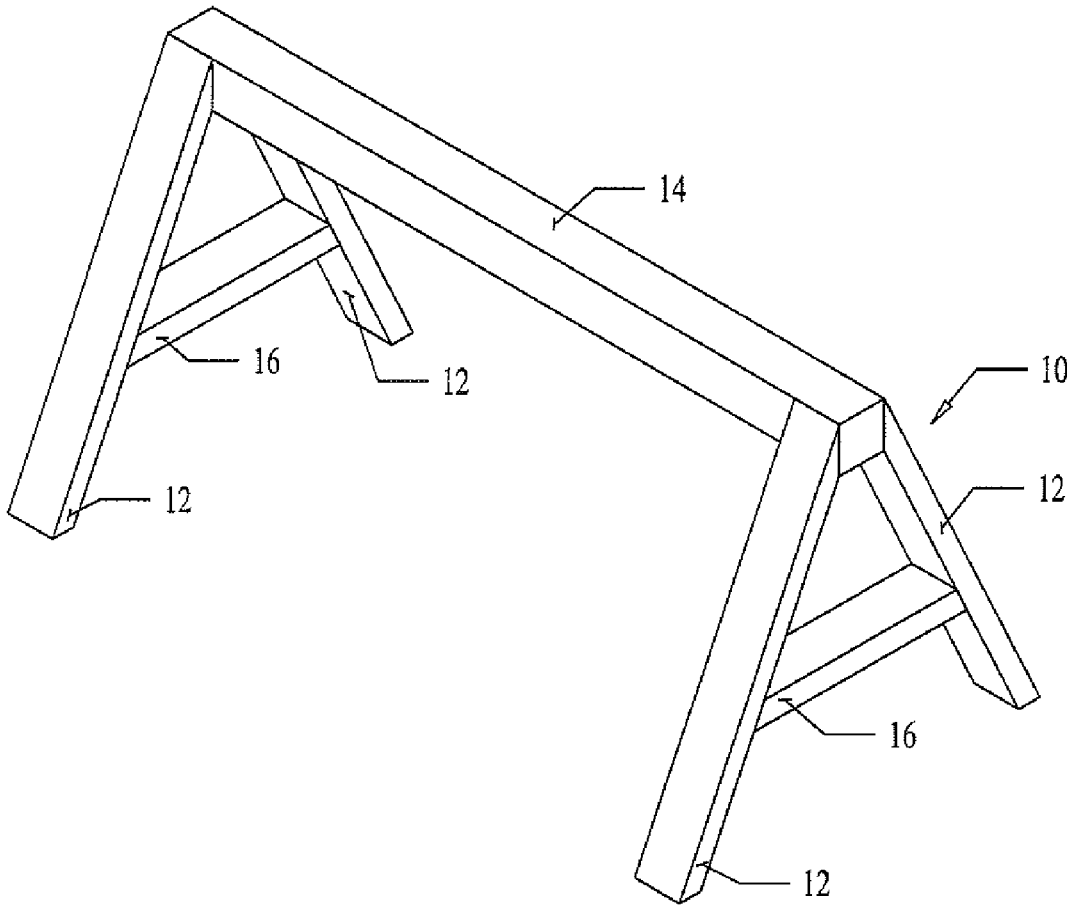
FIG. 1 (PRIOR ART)
FIG. 1 is a depiction of a prior art sawhorse design.
Figure 2A:
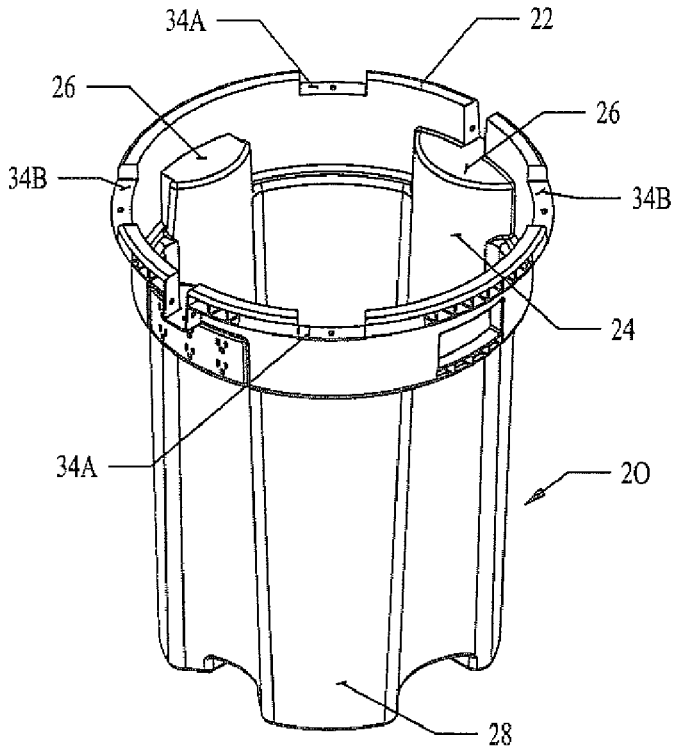
FIG. 2A is a top perspective view of a container of the present invention having a modified rim for application as a sawhorse.

FIG. 2A depicts a top perspective view of a container 20 having a modified rim 22 for use as a sawhorse. Container 20 may be a converted garbage can, or other containment vessel, preferably made of a hard, resilient synthetic or semi-synthetic material, such as plastic, that can be molded or extruded into form. Container 20 may also be fabricated from metal or metal alloys. Container 20 is preferably cylindrical, as found in common household containers, such as garbage cans; however, the present invention is not limited to a cylindrical container, and can be readily adapted for other shaped containers.

Container 20 is shown with molded sidewall support structures 24 that are intended to lend structural support for weight bearing sawhorse applications. Support structures 24 are preferably molded as an integral part of container 20's sidewall. Alternatively, they may be molded as a separate rib, which can be formed inside or outside of the sidewall. Support structures 24 are shown as curved, vertical indentations of the sidewall, with horizontal top surfaces 26 for holding a crosspiece sawhorse structure, such as a plank or board, for use as a sawhorse. Although only a few support structures 24 are shown, container 20 may be reinforced with various types of integrally molded ribs in conjunction with, or in place of, support structures 24. Support structures 24 may not require the additional surface contact area afforded by top surface 26, and as such, may be terminated in a non-horizontal endpoint (not shown). Leg formations 28 are shown adjacent each support structure 24. Although the container sidewall may be a circumferentially smooth surface, the preferred embodiment allows for support structure recesses or indentations to add structural integrity to the container's weight bearing function. Additionally, support structures 24 may be formed by having container 20's sidewall thickness increased at a location near, underneath, or adjacent where sawhorse supports are mounted.

Figure 2B:
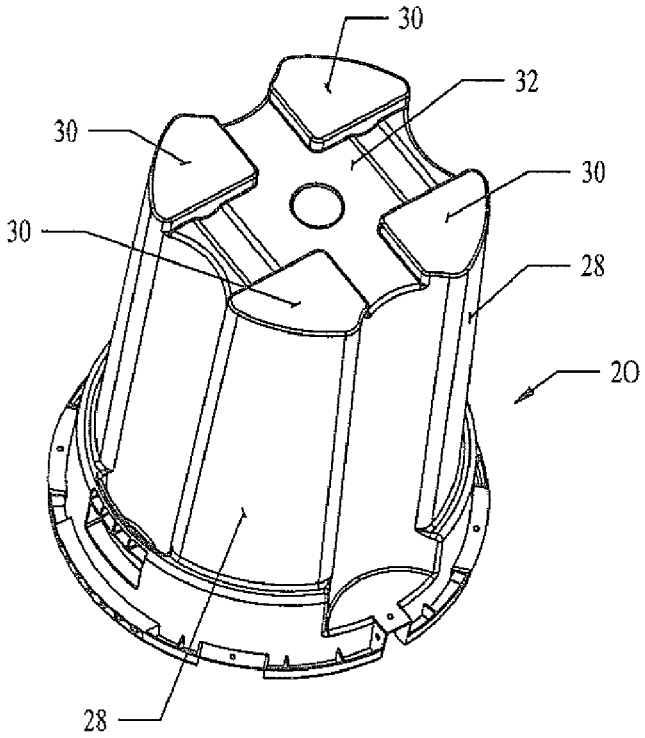
FIG. 2B is a bottom perspective view of a container having a modified bottom surface for application as a sawhorse.

As depicted in FIG. 2B, the bottom end of each leg formation 28 terminates in a footing 30 that extends beyond the bottom surface 32 of container 20. Four leg formations 28 are depicted for enhanced stability; however, since leg formations are preferably integral with container 20, as little as one circumferential lower leg footing may be used in place of the separate leg footings shown. Alternatively, more than four leg formations and respective footings may be employed about the periphery of bottom surface 32. Moreover, bottom surface 32 may also be void of any integral footings, employing a rough or pitted surface instead to reduce slippage. The present invention is not limited to a specific number of leg formations or footings. The only restriction in the design of the container bottom surface is that the container be stable when set up for a sawhorse function.

Figure 2C:
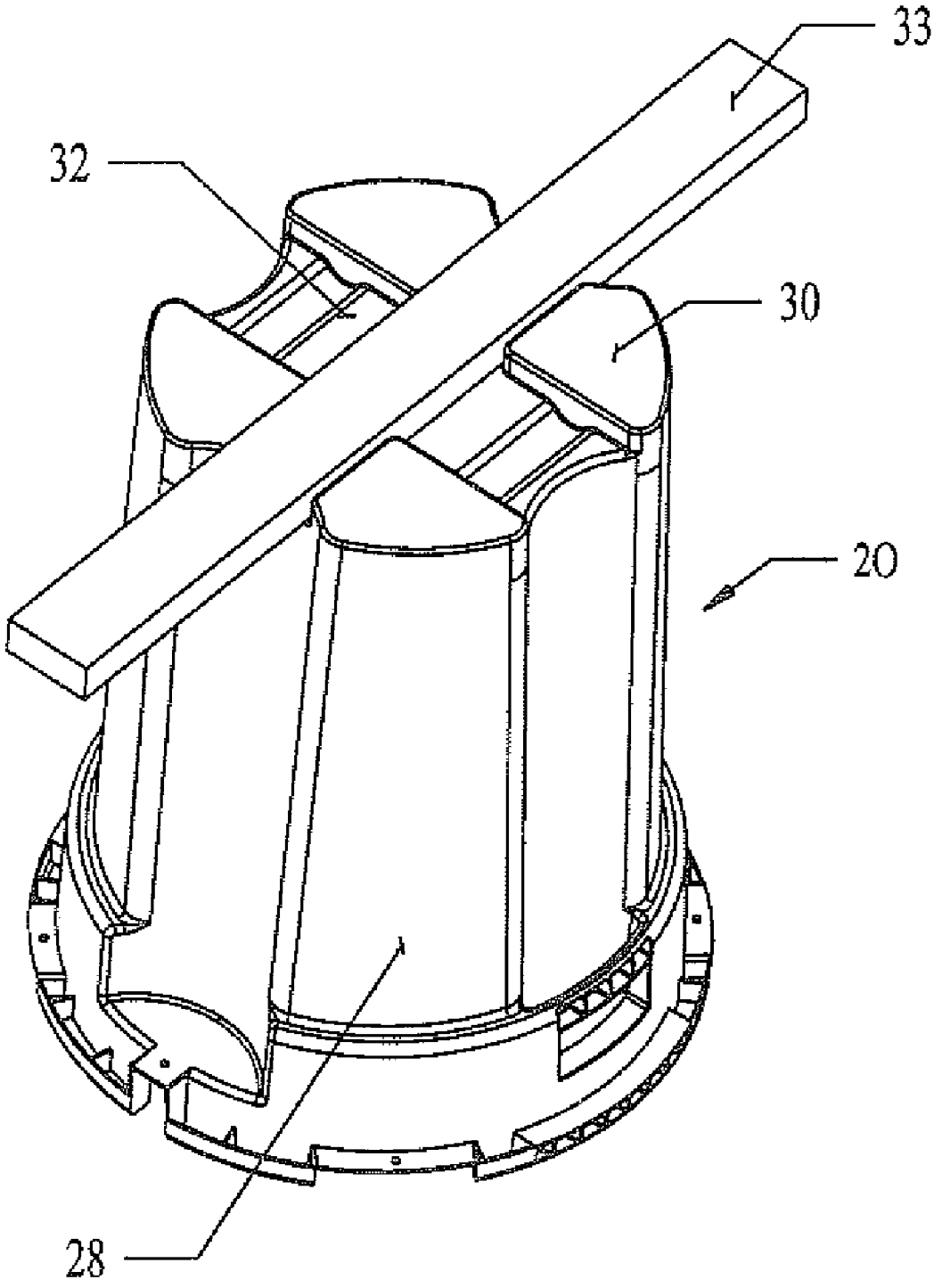
FIG. 2C is a bottom perspective view of the container of FIG. 2B holding a sawhorse support structure.

In an alternative embodiment for the bottom surface of the container, FIG. 2C depicts a bottom perspective view of container 20 having footing terminations 30 spaced apart to allow for the placement of a sawhorse structure 33, such as a board, to be held in place by friction fit or other attachment design. Footing terminations 30 form a recess for sawhorse structure 33. A protruding slotted structure may also be formed on the bottom surface. In this manner, container 20 may be turned upside down, and the bottom surface used as the sawhorse structure holder. This may be advantageous when it is desirable to keep debris or rain from falling into container 20.

Figure 3:
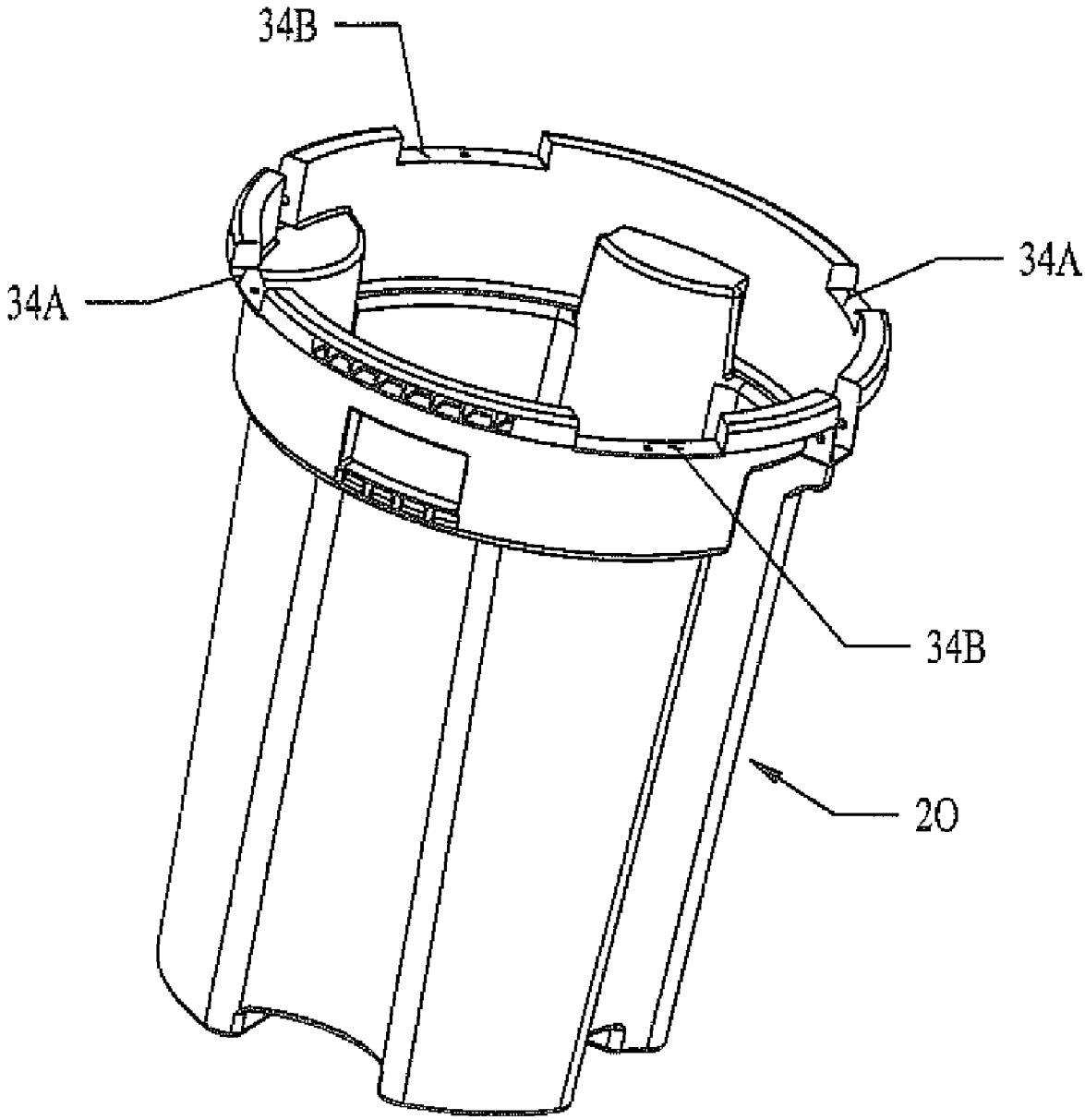
FIG. 3 is a top perspective view of the container of the present invention with two types of recess pairs for holding boards of different widths in a sawhorse application.

Referring to FIG. 2A, container 20 is shown with a pair of square or U-shaped recesses or slots 34 at the top of rim 22. Recesses 34 are preferably integrally formed with container 20. In the preferred embodiment, at least two pairs of recesses 34A, 34B are employed. However, container 20 may be configured with one pair of recesses or a plurality of pairs, and the present design is not limited to any fixed set of recess pairs. FIG. 3 depicts a top perspective view of container 20 with recess pairs 34A, 34B. Each recess 34 is preferably designed with a predetermined width to hold either a 2"×4" board as depicted by the narrow width of recess 34A, or a 2"×6" board, as depicted by the wider width of recess 34B. FIG. 3 represents an illustrative example of the type and quantity of recess pairs that may be employed in the design; however, the quantity and width of each recess pair is arbitrary, and the present invention is not limited to any particular combination. In a preferred embodiment, container 20 is made to accommodate at least one 2"×4" board, and one 2"×6" board.

The predetermined recess widths may be selected to receive either the wide side of a board, or the narrow side of a board. Preferably, a container would have at least one set of recesses to receive a narrow side of a board, since this will allow the board to perform better its weight bearing function. Since the container design is preferably fabricated from an extrusion or molded process, the recess width selections may vary based on certain predetermined configurations for selected containers. Variability of different types of recesses may be governed by demand and market conditions. For illustrative purposes, FIG. 3 is shown with a 2"×6" recess 34B designed to receive the wide portion of the board, while recess 34A is designed to receive the narrow portion of a 2"×4" board. This is a representative embodiment. The present invention is not restricted to this illustrative combination.

Figure 4A:
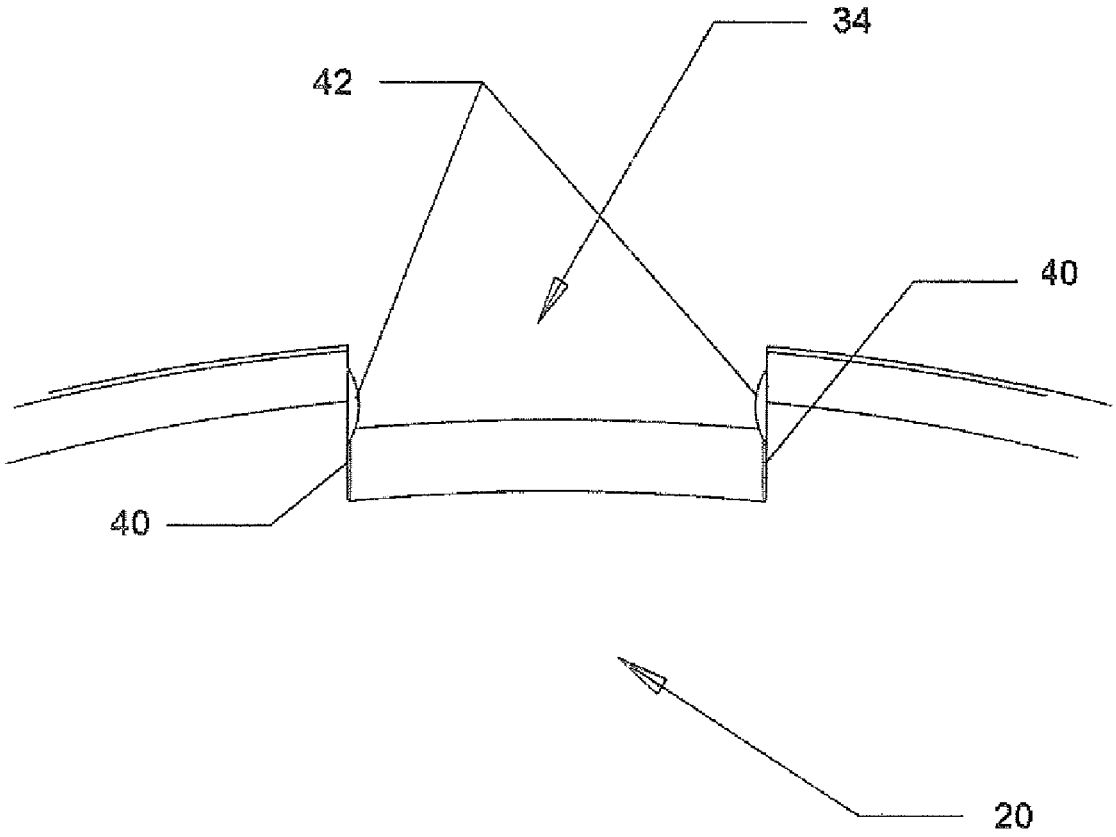
FIG. 4A is a cutout, top perspective view of the inner vertical sides of a slot configured with a protruding resilient material to form a tight friction fit for holding a board.
Figure 4B:
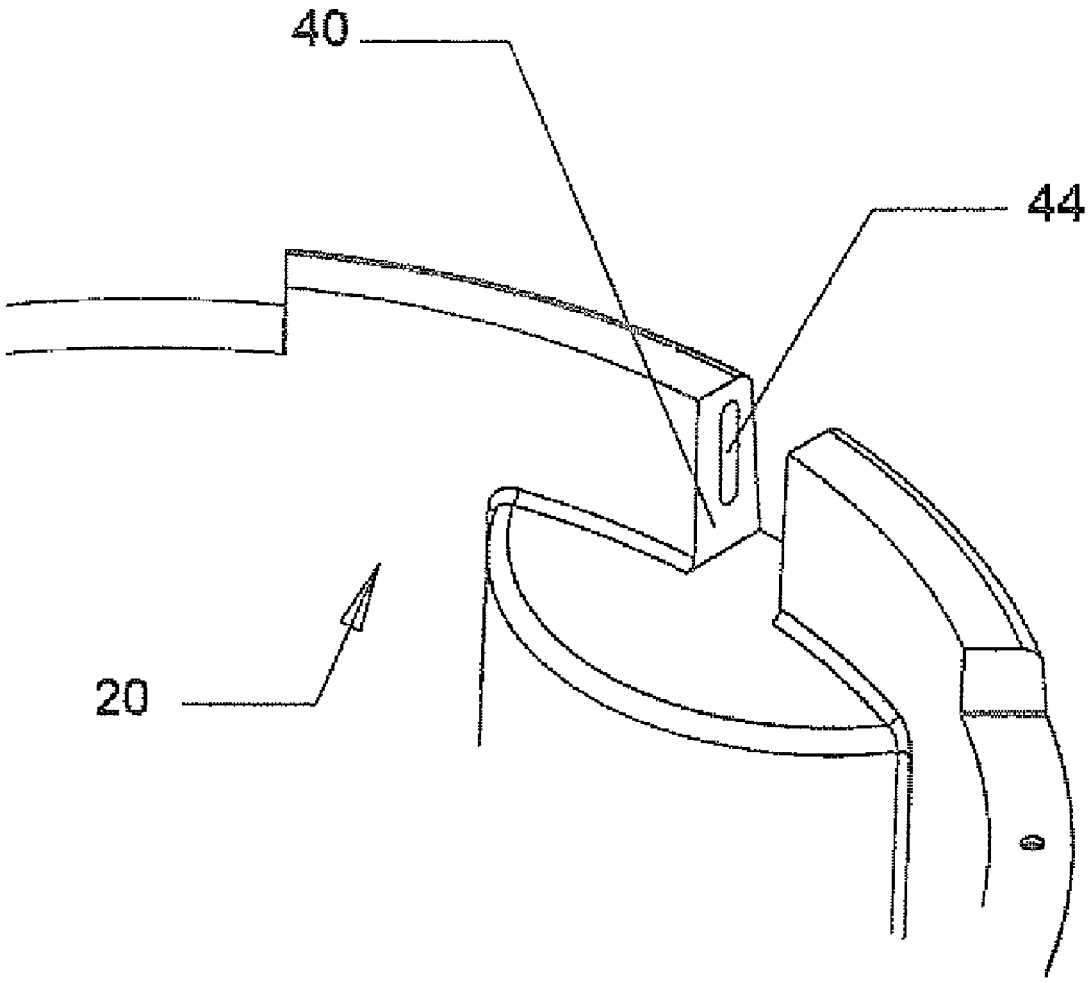
FIG. 4B is a cutout, top perspective view of the inner vertical sides of a slot configured with protruding resilient material integrally formed with the container to faun a tight friction fit for holding a board.
Figure 4C:
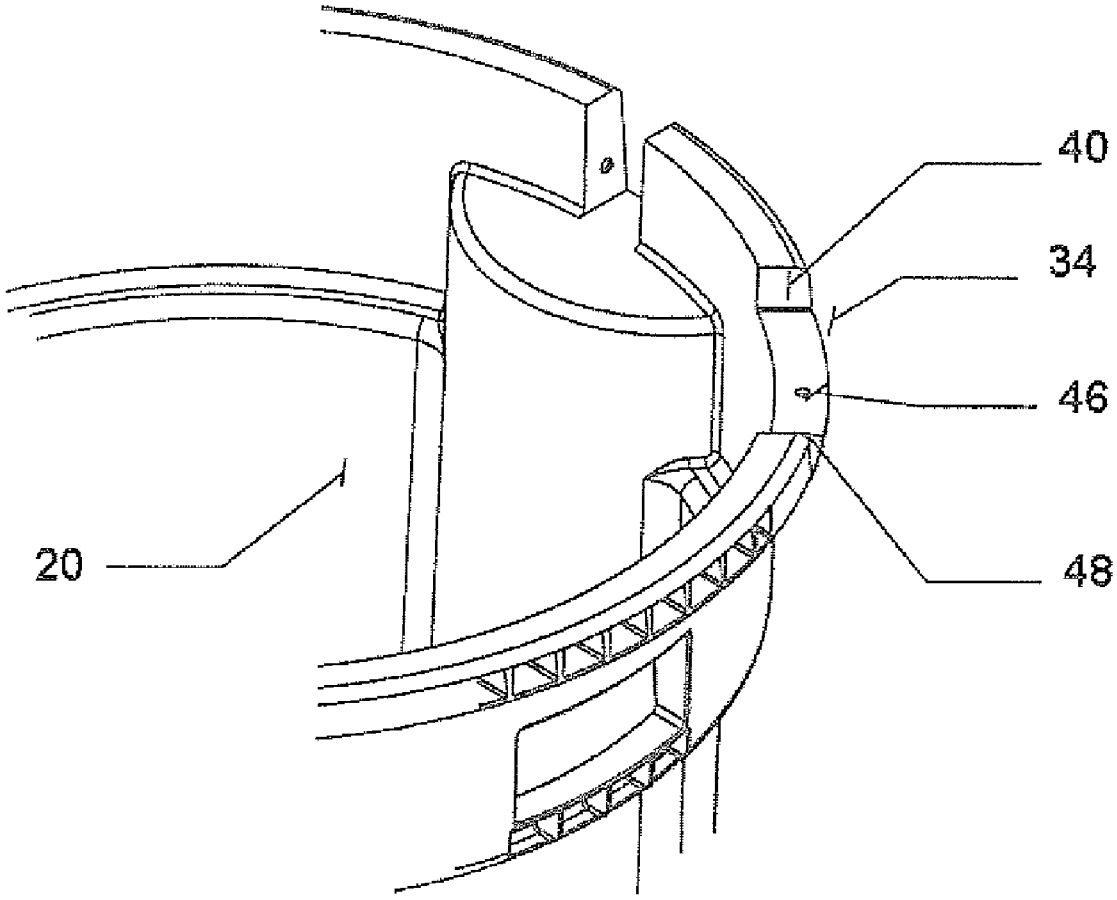
FIG. 4C is a cutout, top perspective view of the slots of the present invention configured with an aperture on the slots bottom face for attaching a board.
Figure 4D:
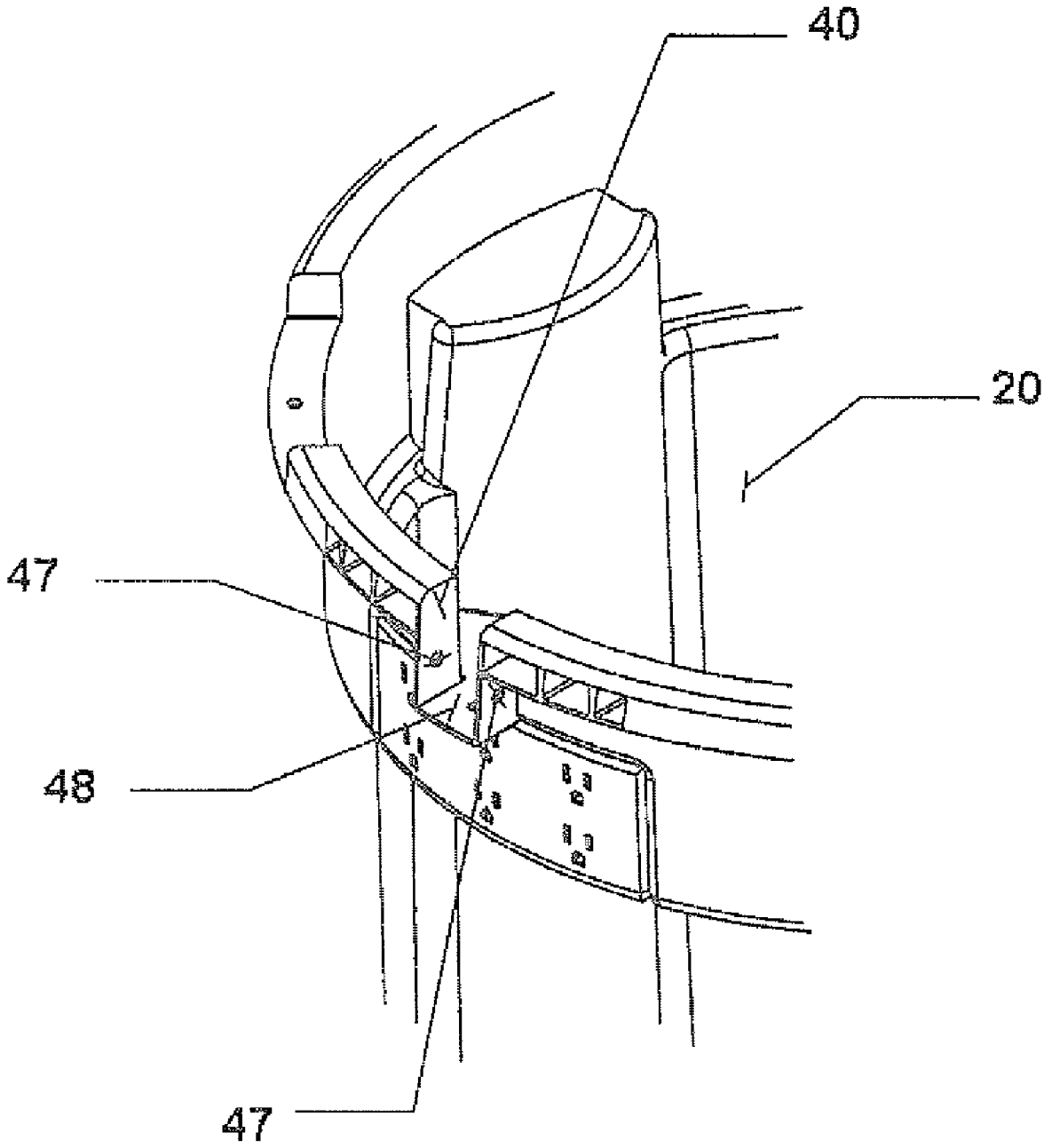
FIG. 4D is a cutout, top perspective view of the slots of the present invention configured with an aperture on the inner vertical sides for attaching a board.

Each recess or slot 34A,B is designed and formed such that it has a measure of resiliency in its width to create a tight, friction fit when a board is inserted therein. This resilient form-fit design may be accomplished in a number of ways. For example, as shown in FIG. 4A, the inner vertical sides 40 of each slot 34 may be configured with a protruding resilient material 42, such as a synthetic rubber or the like, that is compressed upon board insertion. Resilient material 42 may be inserted within an aperture in vertical side 40, attached by mechanical means through vertical side 40, by a screw or the like, or attached by adhesive to the vertical side surface. Alternatively, as depicted in FIG. 4B, the vertical sides 40 may be formed with compressible, resilient protrusions 44, integrally formed with, and made from the same material as container 20. In another embodiment, as shown in FIG. 4C, slots 34 may be molded with aperture 46 through the slot bottom 48. A board with a hole drilled through, may then be inserted into slot 34 such that the board hole is aligned with aperture 46 (see FIG. 5). In this manner, a pin may be inserted through the board and into aperture 46 where it may be secured to container 20. The pin attachment may be performed at either one or both slots of a recess pair. Slots 34 may also be formed with apertures 47 in the inner vertical sides 40 as depicted in FIG. 4D. In this manner, a board may be attached to container 20 by the sides instead of a top-bottom attachment. This provides for a cleaner work surface, allowing the top face of the board to be free of any mechanical structure.

Figure 5:
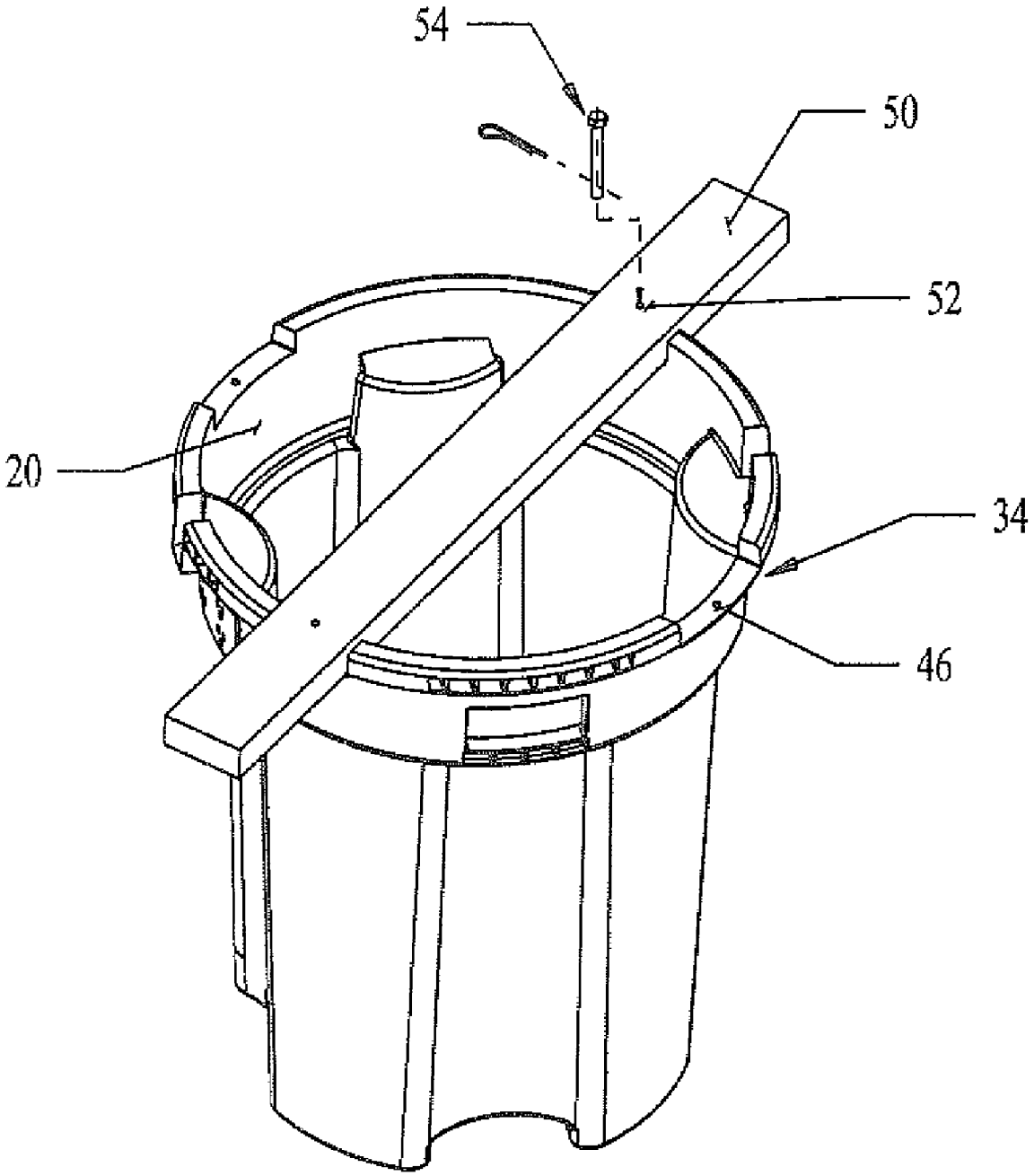
FIG. 5 is a top perspective view of a container in a sawhorse application showing an attachment of a board 50 to an aperture in the base of a slot.

FIG. 5 depicts container 20 in a sawhorse application showing the attachment of a board or sawhorse support 50 having a hole 52 drilled through with a pin or bolt 54 inserted for attachment into aperture 46 at the base of each slot 34. The attachment may also be made with a nail, screw, or the like, where sawhorse support structure 50 need not have a hole drilled through.

Container 20 has a preferred height that will comfortably accommodate a person using the sawhorse without undue crouching, extending, or bending. The general height of a garbage can or tabletop is typically deemed an acceptable height for sawhorse applications, although in no way does the present invention limit the container height to any specific dimension. One advantage of using container 20 of the present invention as a sawhorse is the ability to concurrently use the inside containment portion of the container as a receptacle for work-related debris, such as discarded wood, nails, and other materials generally found at work sites. In this manner, during usage or once the sawhorse application is no longer needed, container 20 may be filled to capacity with debris and used as a refuse collector for the work site. Container 20 may also be used to store tools and equipment during transportation. For situations where container 20 is used by a home hobbyist, it may primarily be used as a refuse collector, and secondarily as a sawhorse when needed. This eliminates the extra storage space that would have been required if a home hobbyist had to store separately both a refuse collector and a sawhorse.

Figure 6:
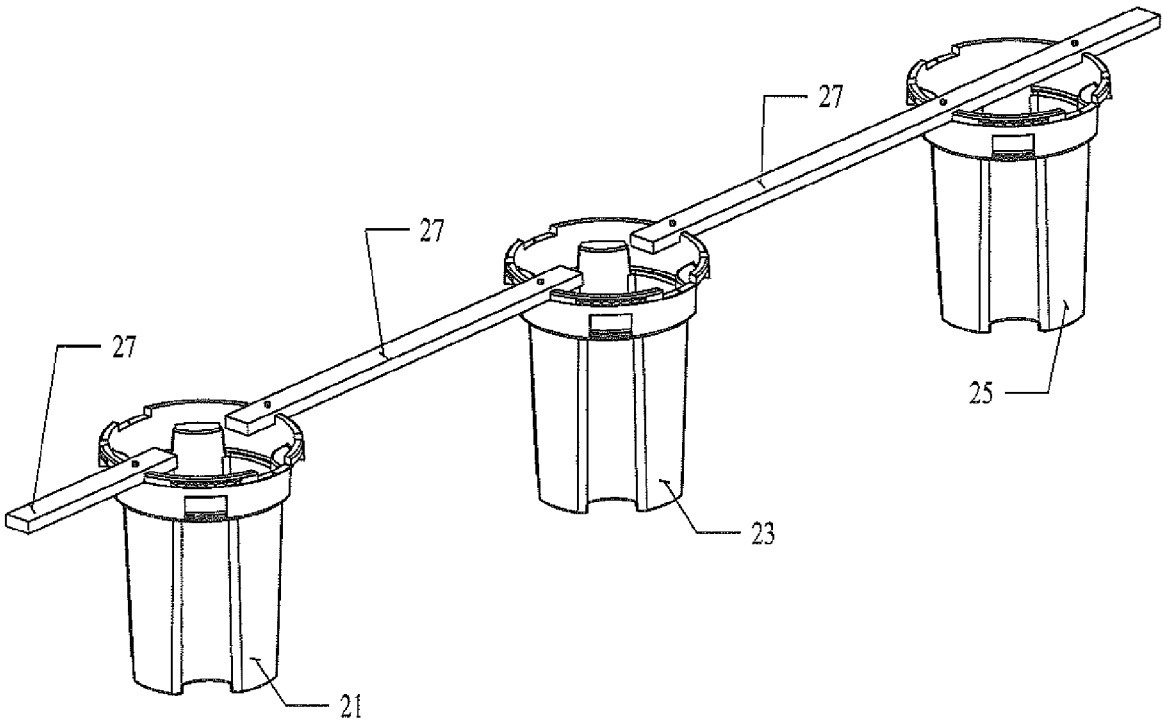
FIG. 6 depicts a side perspective view of three containers sharing cross-boards to form a barricade.

Generally, more than one container of the present invention may be used in tandem for sawhorse applications, scaffolding, barricades, or for creating a workbench. For example, FIG. 6 depicts three containers 21, 23, 25 used in tandem, and sharing cross-boards 27, to form a barricade.

Figure 7:
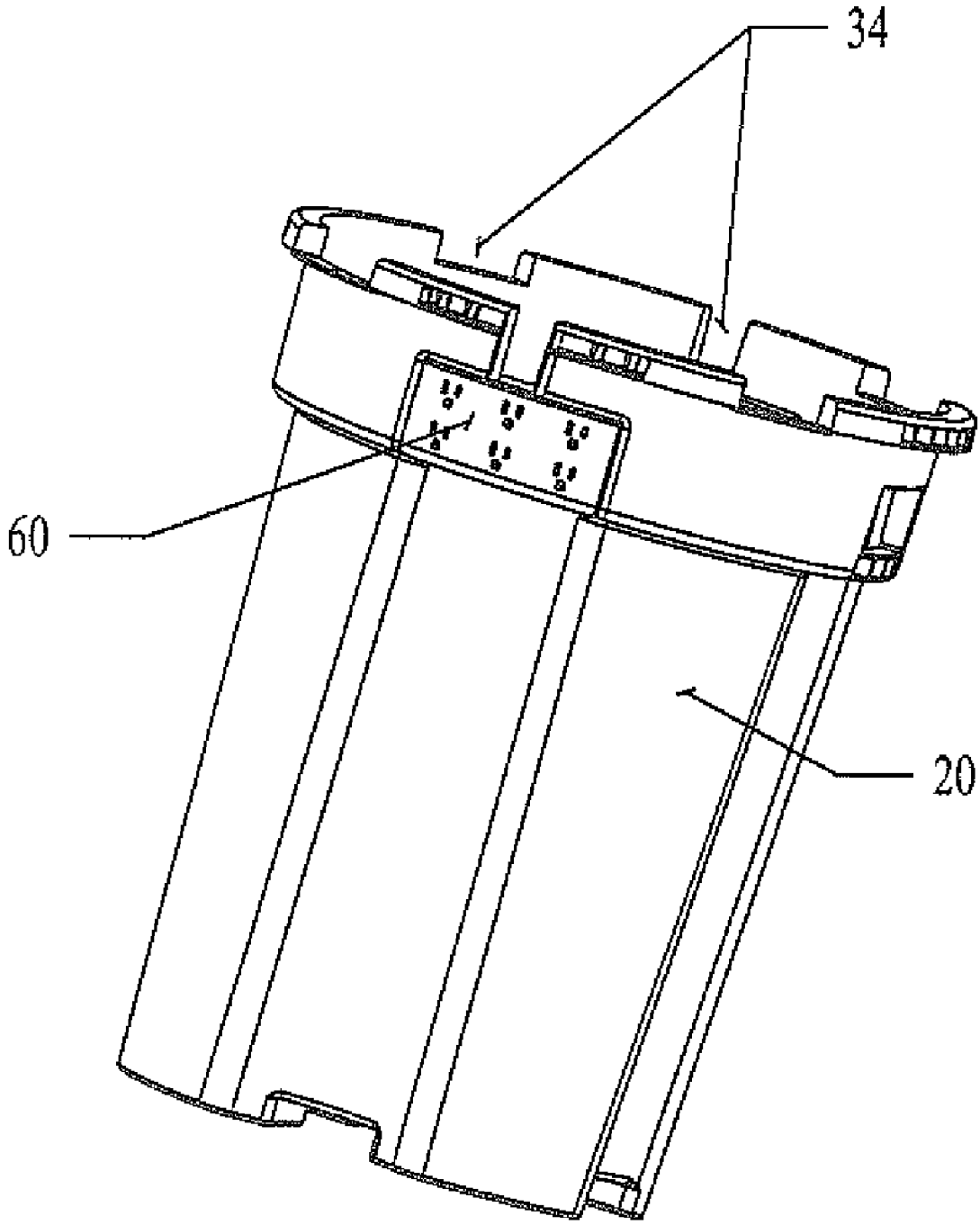
FIG. 7 depicts a top perspective view of a container with an electrical extension outlet mounted within the container sidewall.

Since most workmen must continually work with electrically powered tools in their trade and accordingly use electrical extension cords in order to bring electricity to the work site, it is not uncommon for a workman to drag electrical extension cords over the sawhorse as the tools are being used. This poses a danger for tripping and creates a hazard of cords being caught, cut, or entangled in the power tools. FIG. 7 depicts a top perspective view of container 20 with an electrical extension outlet 60 mounted in the top portion. In this manner only one extension cord is required to service a plurality of power tools.

Figure 8A:
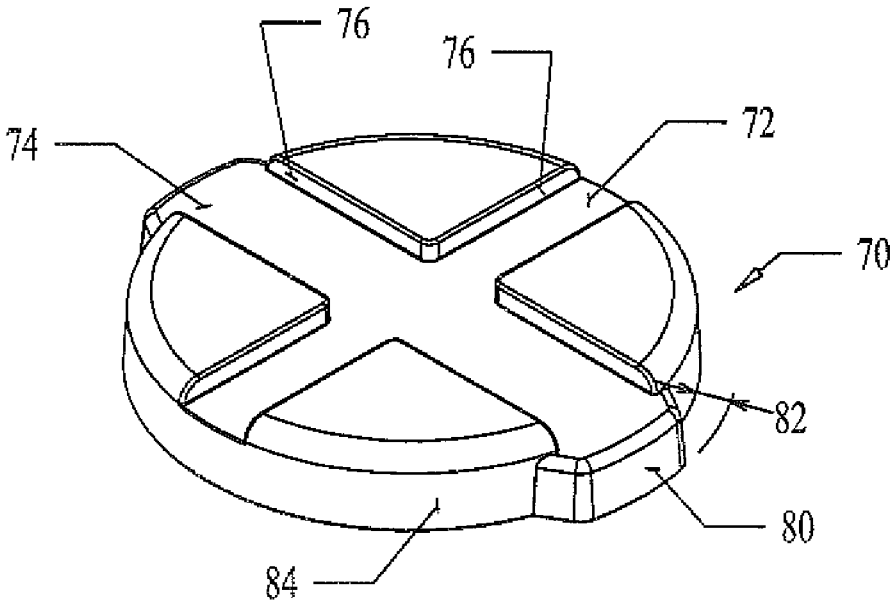
FIG. 8A is a top perspective view of a sawhorse converting receptacle lid of the present invention.

In another embodiment, a lid for a container, such as a garbage can, or other common receptacle, is modified with a slotted structure to hold cross-boards in a manner that allows a user to adapt the receptacle into a sawhorse. FIG. 8A is a top perspective view of a sawhorse converting receptacle lid 70 of the present invention. Lid 70 is shown with two elongated slots 72, 74 for inserting and firmly holding boards. Although recesses are shown, other slotted structures, such as protrusions extending from the lid top surface to make a slot formation, may be formed as well. The slots need not extend the full diameter of the lid. Preferably, the slots are of different widths, giving the user the ability to use different sized boards in sawhorse applications. Although a lid may be adapted for only one slot, it is preferred that at least two slots be available for two different width sawhorse supports. Slot 72 is depicted as a narrower width slot for holding a 2"×4" board (not shown), while slot 74 is a wider slot for receiving a 2"×6" board (not shown). In a preferred embodiment, the 2"×4" board is received on its narrow edge, while the 2"×6" board is received on its wide surface. In the first instance, the 2"×4" board provides for a stronger weight-bearing load. The wide 2"×6" board may be laid flat within slot 74 to allow for a larger work platform. Other combinations of slot widths are possible, and the present invention is not restricted to any specific slot configuration.

Lid 70 is depicted with protrusions or bumpers 76, located on at least one inside face or sidewall of each slot to frictionally hold the sawhorse support. Bumpers 76 are preferably integrally fabricated with lid 70, but may be separate components attached to lid 70. Bumpers 76 perform the same function as, and may be the same as, the compressible, resilient protrusions previously discussed. Bumpers 76 are shown extending substantially the full length of slots 72, 74, although this is not a necessary requisite for friction fitting boards within the slots. A plurality of smaller bumper segments may be employed as well. Alternatively, the bumpers may be formed from protruding resilient material added to each slot's sidewall, for example rubber buttons, and the like. Slots 72, 74 may also be molded with apertures to receive the resilient material, which can be press fitted into the apertures. Moreover, in a similar fashion to the pin attachment described above, slots 72, 74 may be molded with apertures through the bottom or vertical sides of the slots. A board having a hole drilled therethrough may then be inserted into a slot such that the hole is aligned with the slot aperture. A pin, nail, screw, or bolt, may be inserted through the bottom or vertical sides of the slot and through the board, securing the board to the lid. When nails or screws are used, the board need not have a hole drilled through for attachment. The apertures may be at either one end or both ends of the slot. Generally, lids come with handles 80. Preferably, the top portion of handle 80 is fabricated with an extension portion 82, to extend the flat receiving surface of a slot. In an alternative embodiment, an aperture may also be situated on handle 80, extending beyond the rim 84 of lid 70.

Figure 8B:
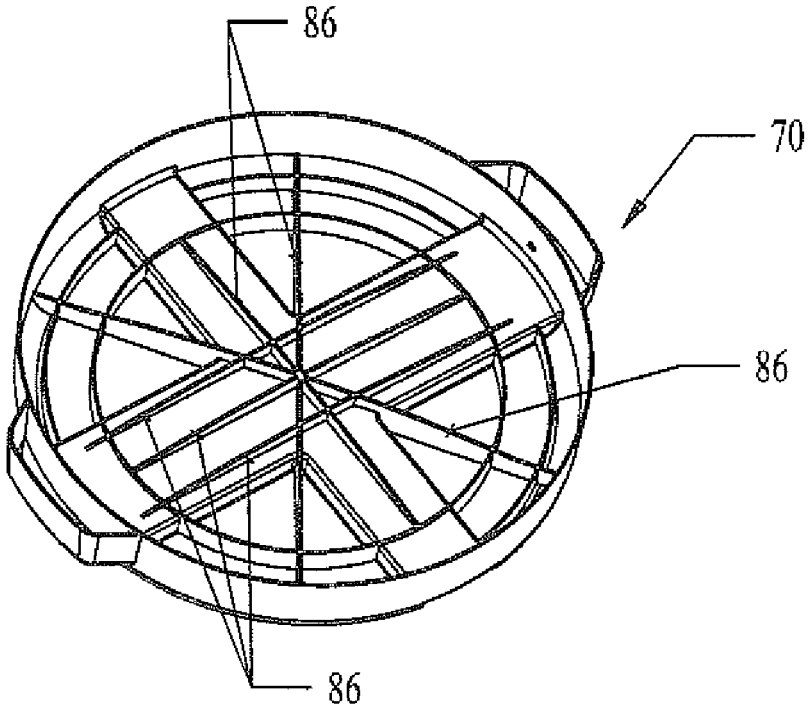
FIG. 8B is a bottom perspective view of the lid of FIG. 8A with a plurality of strengthening ribs for structural support.

Preferably, lid 70 has a diameter for fitting securely on common garbage receptacles, and may be constructed of semi-hard, molded plastic or metal for structural integrity. As shown in FIG. 8B, the underside of lid 70 is preferably populated with a plurality of strengthening ribs 86, and includes an extending lip for fitting securely on the receptacle.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A container having a bottom surface, a top surface rim, and an open interior portion, comprising at least one recess through said rim having a flat recess bottom surface parallel with said top surface rim and said container bottom surface, and vertical sides approximately perpendicular to said recess bottom surface, for releasably securing a sawhorse support, such that said open interior portion is accessible during sawhorse applications when a sawhorse support is placed in said at least one recess and rested on said at least one recess bottom surface, said at least one recess having a predetermined width to fit a sawhorse support, said width having a dimension for receiving standard lumber used in residential and commercial building, said container including at least one resilient protrusion extending into said recess from at least one vertical side of said at least one recess for releasably securing a sawhorse support in a friction fit.

2. The container of claim 1 wherein said at least one recess comprises an approximately square-shaped recess, located in or on said top surface rim.

3. The container of claim 1 including at least one pair of recesses in said top surface rim diametrically opposed one another.

4. The container of claim 1 including having said at least one resilient protrusion integrally formed with said recess.

5. The container of claim 1 including at least one aperture through said at least one vertical side of said recess for securing said sawhorse support to said container.

6. The container of claim 1 including at least one aperture within said bottom surface of said recess for securing said sawhorse support to said container.

7. The container of claim 1 including at least one strengthening rib or sidewall support structure at a location near or adjacent to said at least one recess.

8. The container of claim 7 wherein said at least one strengthening rib or sidewall support structure includes a horizontal top surface parallel with said bottom surface of said recess for resting said sawhorse support.

9. The container of claim 8 wherein said at least one strengthening rib or sidewall support structure comprises a thicker container sidewall at a location near, adjacent to, or underneath said at least one recess.

10. The container of claim 7 having said at least one recess and said at least one strengthening rib or sidewall support structure integrally formed with said container.

11. The container of claim 1 including at least one electrical extension outlet mounted to said container.

12. The container of claim 1 including a bottom having a bottom surface comprising:

at least one recess or a form-shaped slot in or on said bottom surface and through a sidewall of said container for receiving, and releasably securing, a sawhorse support extending outward from, and approximately perpendicular to, said sidewall.

13. A container having a bottom surface, a top surface rim, and an open top interior portion, comprising:

at least one recess through said rim having a flat recess bottom surface parallel with said top surface rim and said container bottom surface, and vertical sides approximately perpendicular to said recess bottom surface, for releasably securing a sawhorse support, such that said open interior portion is accessible during sawhorse applications when a sawhorse support is placed in said at least one recess and rested on said at least one recess bottom surface, said at least one recess having a predetermined width to fit a sawhorse support, said width having a dimension for receiving standard lumber used in residential and commercial building, said container including at least one resilient protrusion extending into said recess from at least one vertical side of said at least one recess for releasably securing a sawhorse support in a friction fit;

at least one slotted structure in or on said bottom surface for releasably securing a sawhorse support, said slotted structure extending through a sidewall of said container for receiving a sawhorse support extending outward from, and approximately perpendicular to, said sidewall when said container is turned upside down so that said bottom surface is exposed;

at least one strengthening rib or side wall support structure at a location near or adjacent to said at least one slotted structure;

said at least one slotted structure and said at least one strengthening rib or sidewall support structure integrally formed with said container;

said at least one slotted structure having a predetermined width to fit a sawhorse support, such that said at least one slotted structure is formed to hold said sawhorse support, said predetermine width having a dimension for receiving standard lumber used in residential and commercial building;

said container bottom surface having a footprint area greater than said open top interior portion such that when said container is laced upside down and said bottom surface is exposed to hold a sawhorse support, said container remains vertically stable.

14. The container of claim 13 including at least one resilient protrusion extending from at least one vertical side of said at least one slotted structure for holding said sawhorse support in a friction fit, said at least one resilient protrusion integrally formed with said slotted structure.

* * * * *